US005101935A

United States Patent [19]

LaBianca

[11] Patent Number: 5,101,935

[45] Date of Patent: Apr. 7, 1992

[54] HOISTING AND RESCUE APPARATUS

[76] Inventor: Gaspare LaBianca, 100 W. 94th St., New York, N.Y. 10025

[21] Appl. No.: 633,091

[22] Filed: Dec. 21, 1990

[51] Int. Cl.[5] ..... E04G 3/10

[52] U.S. Cl. ..... 182/236; 182/42; 182/57; 182/142

[58] Field of Search ..... 182/236, 4, 42–44, 182/57–62, 142

[56] References Cited

U.S. PATENT DOCUMENTS 187,569 2/1877 Tixier ..... 182/42 X
241,509 5/1881 Payne .
265,923 10/1882 Hamilton .
293,680 2/1884 Steinwender .
321,212 6/1885 Hargrave et al. .
471,145 5/1892 Schneider .
560,474 5/1896 Clabron .
794,712 7/1905 Hill .
1,147,365 7/1915 Boulieu et al. .
2,049,353 7/1936 Cary ..... 182/62
3,871,480 3/1975 Sauri .
3,894,613 7/1975 Elizondo .

*Primary Examiner*—Alvin C. Chin-Shue
*Attorney, Agent, or Firm*—Felfe & Lynch

[57] ABSTRACT

The present invention provides an apparatus that can be used for hoisting and rescue purposes at significant elevations such as in high rise buildings.

22 Claims, 14 Drawing Sheets

CONTROL FLOOR

LANDING FLOOR

HOISTING AND RESCUE APPARATUS

FIELD OF THE INVENTION

This invention is directed in general to equipment and apparatus that can be used for hoisting and rescue. The apparatus of this invention is particularly useful in hoisting and rescue applications at significant elevations, for example in high rise buildings.

BACKGROUND OF THE INVENTION

High rise building rescues have heretofore not been possible without the use of tremendous amounts of equipment and manpower, including, for example, helicopters and other heavy equipment. Due to such tremendous equipment requirements, rescuers have oftentimes been forced to function during a rescue attempt in significantly exhausted states, accelerating the already dangerous working conditions.

It is therefore an object of the present invention to provide an apparatus and method of its use which significantly simplifies such high rise rescues and is less stressful to install and operate.

It is a further object of this invention to provide a light-weight, portable, simply installed apparatus that when operated by trained personnel can hoist or lower heavy loads of cargo or evacuate people from high elevations, for example one hundred stories or more at high speeds with relative safety.

Another object of this invention is to provide an apparatus which can be carried to and rapidly installed in a suitable location from which a secure mooring can be made permitting a rescuer to rappel down to a select location to attend to or effect rescue of victims.

These and other objects accomplished by the present invention, will be more fully understood from the following discussion which refers to drawings of preferred embodiments of the invention.

DETAILED DESCRIPTION OF PREFERRED EMBODIMENTS INVENTION

In one important aspect the apparatus of this invention provides an apparatus and method of use which significantly simplifies and expedites the rescue and evacuation of people from high elevations, for example, in high rise buildings.

In one preferred embodiment, the hoisting and rescue apparatus is portable and sufficiently light-weight to be easily and rapidly installed by trained personnel. Such portable apparatus can be collapsible and stored, for example, on the top floor of separate wings of high rise hospital or hotel or office buildings and constructed to be sufficiently light to be either transported by rescuers to a roof setting to be installed, or, for example, it can be installed on intermediate "control" floors, or conveniently carried up from a ground or landing floor.

In another embodiment, the hoisting and rescue apparatus of this invention can be of a heavy duty construction, enabling greater evacuation or lifting capacity. Such a heavy duty apparatus can be stored as would be the portable apparatus, and carried or hoisted in place and installed, for example, by an installed portable apparatus of this invention.

In a further embodiment, the apparatus of this invention can be equipped with an auxiliary feature to easily and rapidly install components of the hoisting and rescue apparatus of this invention, including the installation of a heavy duty apparatus.

HOISTING AND RESCUE APPARATUS AND OPERATION

Figure 1A:
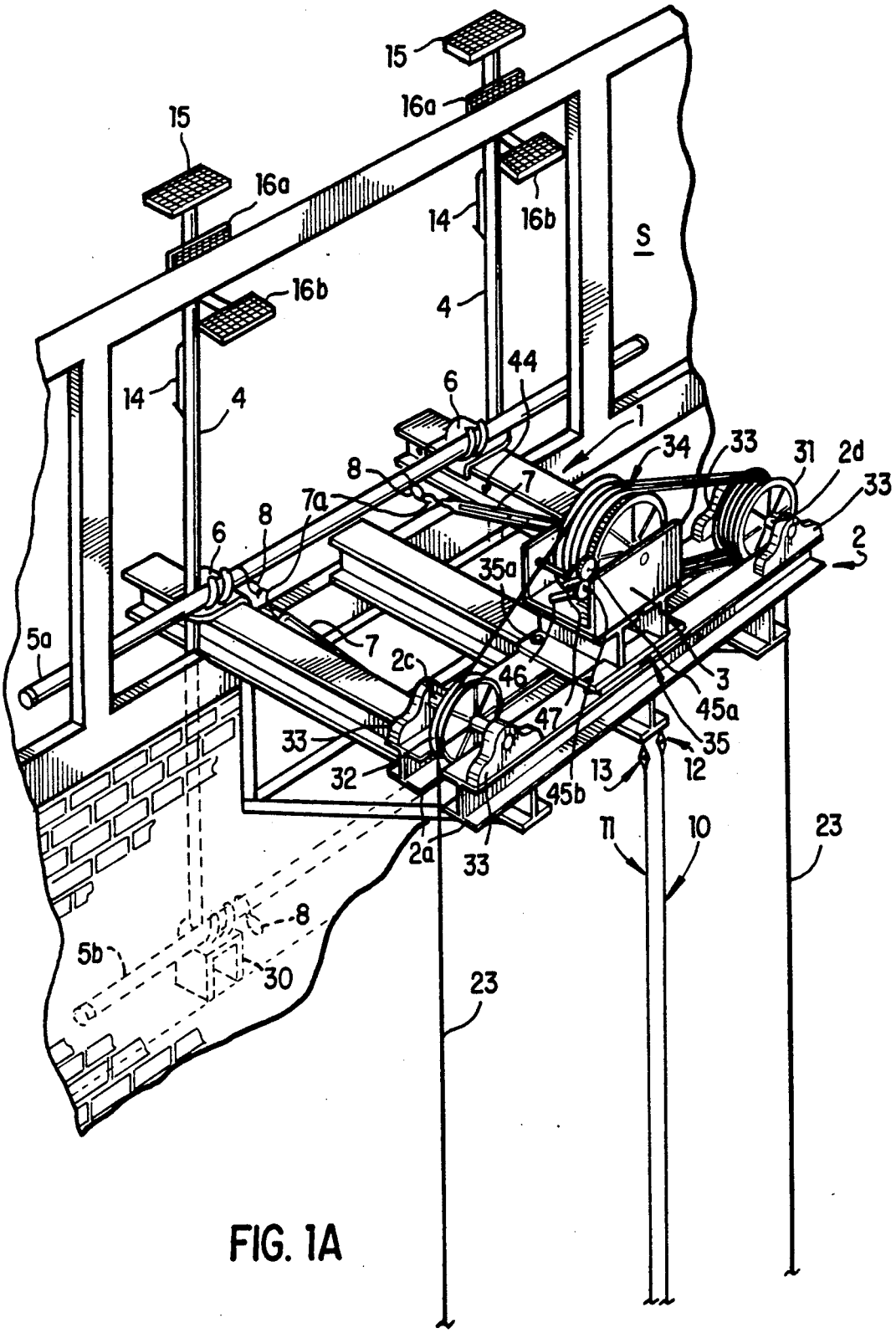
FIGS. 1A, 1B and 1C together form a composite perspective view of a preferred embodiment of the hoisting and rescue apparatus of the invention illustrating its components and installment in a window frame.
Figure 1B:
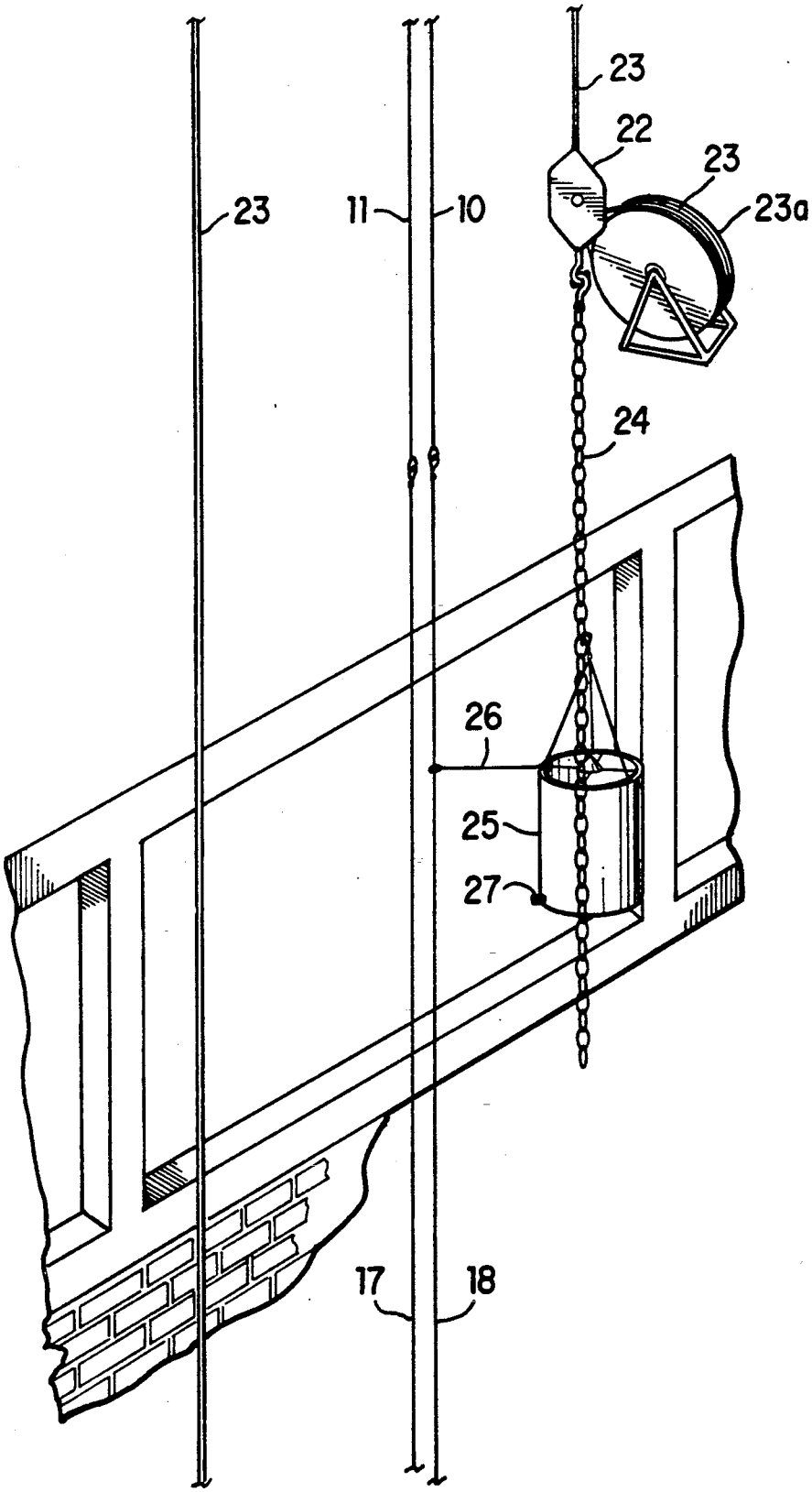
Figure 1C:
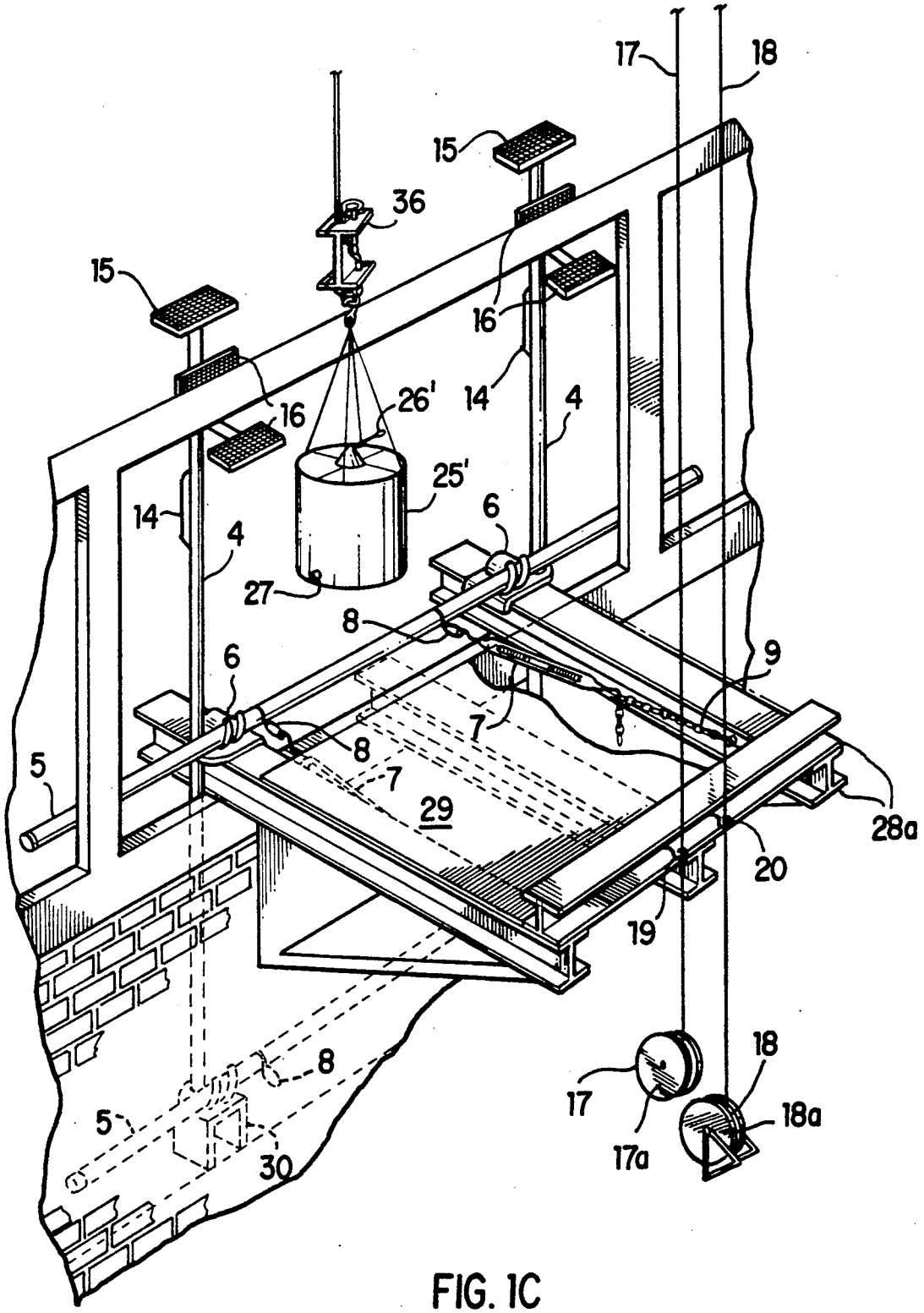

Referring now to the composite of FIGS. 1A, 1B and 1C there is illustrated in perspective view an embodiment of the apparatus of this invention installed in a window frame location operable on the outside of a building. As shown in FIG. 1A, an E-Frame 1 is attached on its outer upper end to an I-Frame 2. The two frames can, for example, be bolted or welded together depending upon if the apparatus is designed to be portable.

Figure 3C:
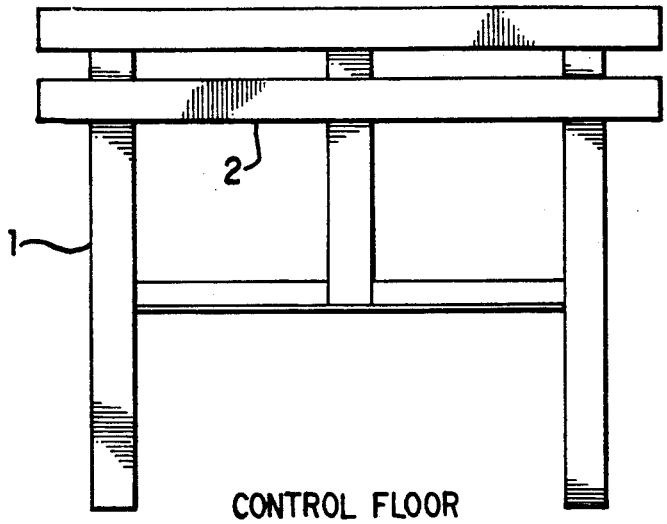
FIG. 3C is a plan view of a detailed schematic of the components of FIG. 3A and 3B assembled as a unit, and for use in the apparatus of FIGS. 1A and 1C, and 2.
Figure 3D:
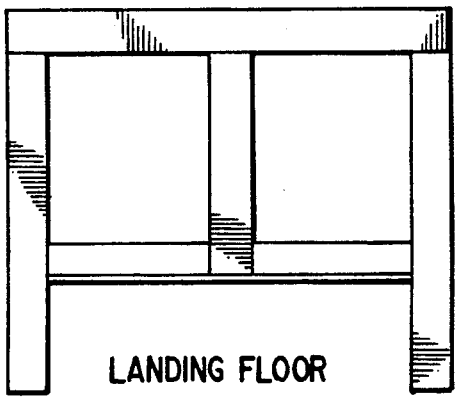
FIG. 3D is a detailed schematic of a component in FIG. 1C.
Figure 3A:
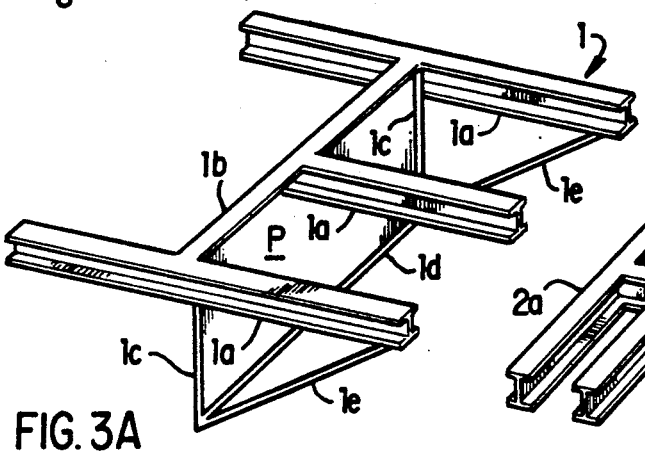
FIGS. 3A and 3B are perspective views of components of the apparatus shown in the composite of FIGS. 1A and 1C and 2.

The E-Frame comprises three parallel beams 1*a*, for example, I-beams, and which are each connected to a crossbar 1*b* which can be at right angles thereto such as illustrated in FIG. 1A. See also FIG. 3A. Cross bar 1*b* is connected at each end to two support bars 1*c* at right angles and each end of the support bars 1c are in turn connected at right angles to cross bar 1d. Support bars 1e angularly project outwardly from the intersection of support bars 1c and cross bar 1d, where they form a connection and are connected at their other ends to the ends of the two outermost parallel beams 1a. As shown in more detail in FIG. 3A, in side view the E-Frame is of a triangular configuration. It is also contemplated in this invention that the area enclosed and defined by cross bar 1b, support bars 1C and cross bar 1d be a one piece back plate "P" in continuous form or a skeletonized backplate, depending, for example, if a portable apparatus is used in accordance with this invention from which the parallel beams 1a and support bars 1e angularly project from. FIG. 3C shows a plan view of the arrangement of E-Frame 1 and I-Frame 2 attached as a unit.

Figure 3B:
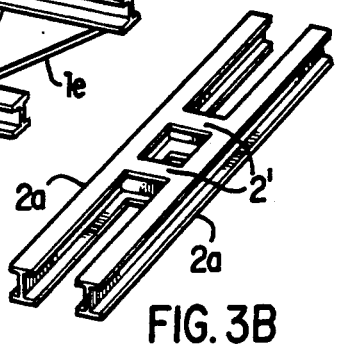

The I-Frame 2 comprises two parallel I-beams 2a with a pulley at each end, 31 and 32, fixed on steel shafts 2c which are supported by two pillow blocks 36. The I-beams 2a of the I-Frame 2 can be connected by one or more transverse support bars 2. See FIG. 3B. On one side of the I-Frame 2 is four-groove pulley 31 which has grooves relative to the size of cable to be used as a tow line and to which pulleys 31, 32 and an additional pulley 34, described more fully below, must conform and align. As illustrated in the preferred embodiment shown in FIG. 1A, pulley 31 is on the left-side. On the other side of the I-Frame 2, the right side illustrated in FIG. 1A, single groove pulley 32, supported in the same manner as pulley 31, is situated. A capstan 3, supports large four-grooved pulley 34, fixed on a steel shaft 2c coupled with a main toothed gear means 45 which is controlled by friction brake 46 and/or pawl 47, which can stop the motion of pulley 34 on shaft 2c by the interaction of intermeshing locking teeth of pawl 47 with gears 45a and 45b, which in turn intermeshes and locks the teeth of main gear means 45. Friction brake 46 can be of any conventional design including a shoe or disk brake. When pawl means 47 is not engaged and brake means 46 is not applied, a state of free wheeling in pulley 34 exists in either a forward or backward direction. Brake means 46 can stop or slow the motion of a cable wound on pulley 34 when moving in either direction. The weight and speed of a load on a cable wound in this manner will of course determine the capacity of brake 46 and other factors, such as the time required to stop the motion of pulley 34. Pawl means 47 can hold a load on a cable wound on pulley 34 when pulley 34 is at rest and lock the motion of the cable in either direction. The capstan 3 with pulley 34, brake means 46 and pawl means 47 can be easily installed as a unit, for example, by mounting said components on a plate, such as the bottom plate of the capstan, which plate can then slide into place under a back plate 35 installed on I-Beam 2 and held in place by overlapping interference of the back plate 35, and fixed by bolting positions 35a on holding plate 35.

Horizontal bars 5 and vertical bars 4 are shown in FIG. 1A placed in position. In this preferred embodiment, top horizontal bar 5a rests and is secured in the channel of the upper, or in this embodiment, window trail clamps 6, with the ends of the bar 5 resting against and bearing upon inside portions of the vertical sides of window sill S. Window trail clamps 6 are positioned over the trail ends of E-Frame 1. For a snug fit, window trail clamps 6 are preferably contoured to shape or mimic the surface topography and side profile of the trail ends of E-Frame 1 such as inverted "U" shape or a generally upsidedown "L" shape. Bottom horizontal bar 5b rests and is secured in the channel of lower trail clamps 30 (not resting on the trail ends of E-Frame 1 in this embodiment) with the entire length of bar 5b resting against and bearing upon an inside portion of the building below the window sill.

Figure 4:
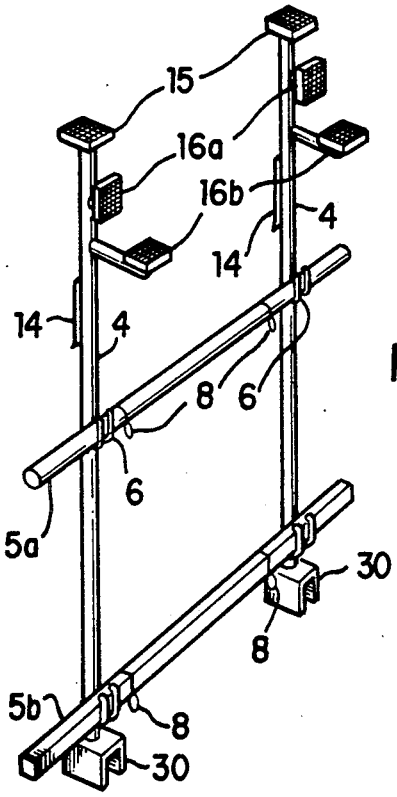
FIG. 4, 4A, 4B and 4C are detailed perspective views of preferred embodiments of assembly and connection components for use in the apparatus of the invention illustrated in FIGS. 1A, 1C and 2.
Figure 4A:
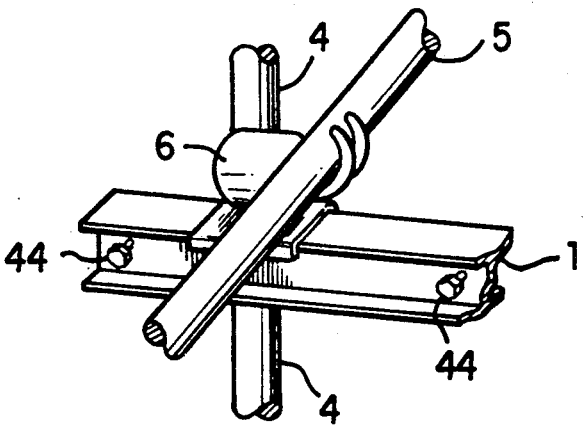
Figure 4B:
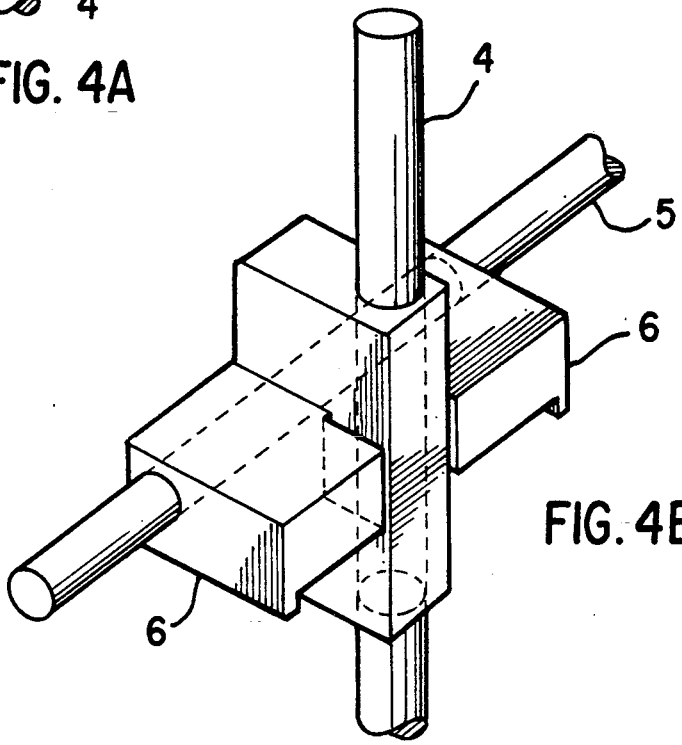
Figure 4C:
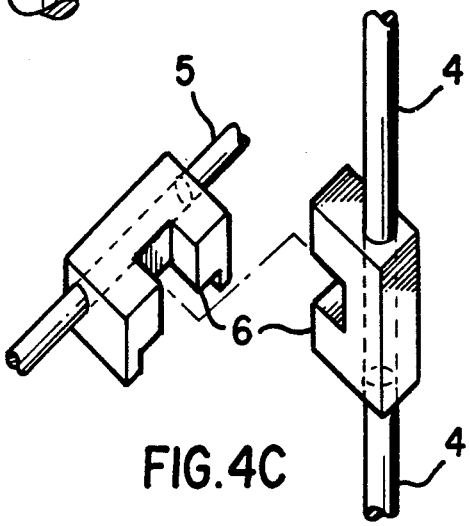

Vertical bars 4 are also shown in FIG. 1A placed in position, by passing through each of window trail clamps 6 and resting each of their bottom ends in respective lower trail clamps 30 wherein the ends of bars 4 are resting against and bearing upon an inside portion of the horizontal sides of the window sill. On the top end of each vertical bar 4 are ceiling securing pads 15 and vertical and horizontal auxiliary securing pads 16a, 16b respectively. In this preferred embodiment, the face of vertical securing pad 16a rests and bears against an inside portion of the upper horizontal side of the window sill S. These pads are preferably of a non-slip, non-skid material, for example, pliable rubber, to aid in securing vertical poles 4 in position by tension and friction. The arrangement and features of horizontal bars 5 and vertical bars 4 with trail clamps 6 and 30 and securing pad 15, 16a and 16b are further illustrated in detail in FIG. 4. Further, FIGS. 4B and 4C illustrate in detail embodiments of apparatus useful in this invention for installing and connecting bars 4 and 5. FIG. 4A illustrates vertical and horizontal bars 4 and 5 installed in trail clamp 6, as utilized in the window installation of FIG. 1A. FIGS. 4B, 4C show alternate block type connectors thereby illustrating some of the many variations of connectors which can be used in this invention.

Vertical and horizontal bars 4 and 5 can be tubular or of solid rod construction, rectangular or take on any shape that does not impede their positioning, strength, lightness of weight, durability and other desirable characteristics. Further, the vertical bars 4 can be expanded up to ceiling height, for example, ten feet or more. Height extensions are dictated by practical limitations, for example, the circumference and strength limitations of the vertical bars. For purposes of extension vertical bars 4 can be equipped with inner vertical extension bars 4a to extend the height of vertical bar 4 in increments and secured in place at a desirable extension, for example, by latch handles 14. A desirable extension would be when ceiling pad 15 is in direct communication with a ceiling, and behind window frames or shaft openings.

It will also be appreciated by persons skilled in the art that the cantilever configuration of the E-Frame 1 is able to easily assimilate changing load stresses created from single strand suspended, possibly moving, possibly swinging cargo, to be exerted and distributed, for example, on a backplate.

Figure 5A:
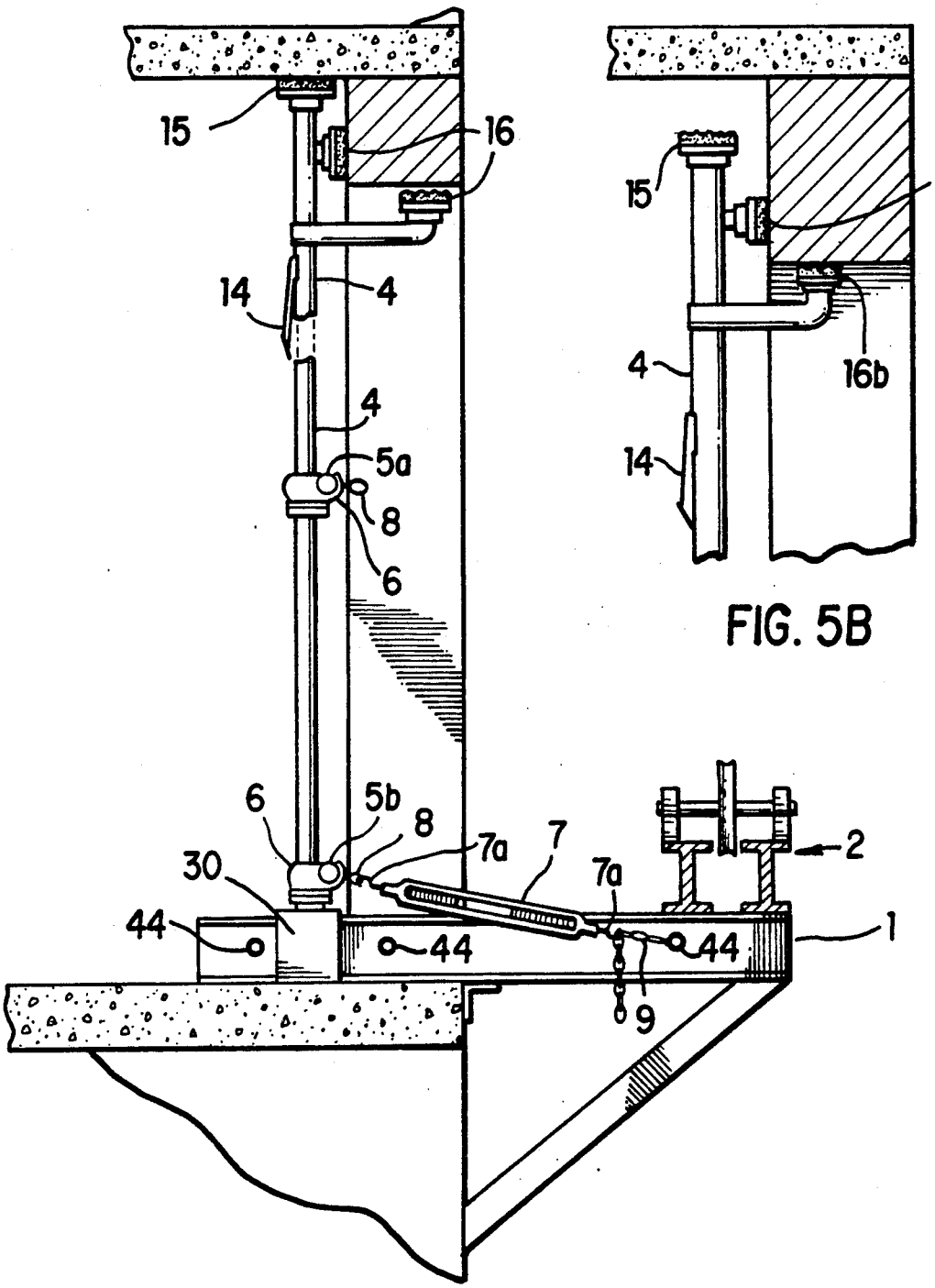
FIGS. 5A and 5B are detailed schematic side views of the assembled hoisting and rescue apparatus of the invention illustrated in FIGS. 1A, 1C and 2.
Figure 5B:
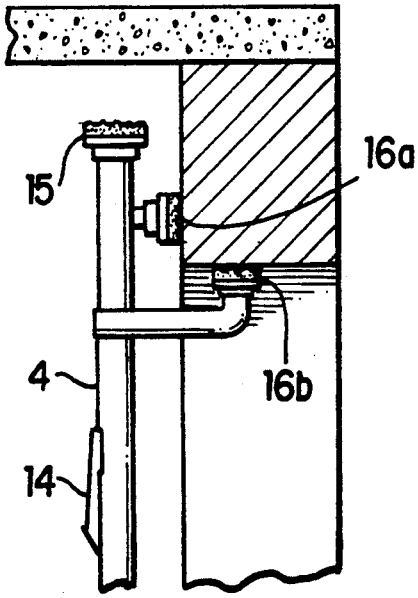

After placement of horizontal bars 5 and vertical bars 4, one end of each turnbuckle 7 is disengaged from its storage position on holding bolts 44 on the inside surface of each side of E-Frame 1, and is then engaged onto eyes 8, which in this embodiment are on a portion of the top horizontal bar 5a, by an attachment means 7a, for example a hook, on ends of turnbuckles 7. Each other end of the turnbuckles 7 also has an attachment means 7a, such a hook, which has been inserted through a link of respective attachment chains 9 to take up as much slack in attachment chains 9 as deemed necessary, and each turnbuckle thus in position is then tightened to pull taught attachment chains 9 and to thereby tensionally hold the assembly of E-Frame 1 and vertical and horizontal bars 4 and 5 in position as a unit in the window frame. As shown in FIG. 1A, when installed, the ends of vertical and horizontal bars 4 and 5 are adapted to bear upon and against the inside window sill S or to prevent the above-described assembly from falling or being drawn outward and to hold and maintain the E-Frame 1 with its above-attachments and features in place protruding from the window for use such as more fully described hereinbelow. FIG. 5A illustrates a detailed side view of the above-described arrangement with turnbuckles 7 positioned and secured in place and between attachment chain 9 and eye 8 of horizontal bar 5. FIG. 5B illustrates an alternative embodiment of engaging securing pads 16*a* and 16*b* with a portion of a window sill or air shaft frame. This unit assembly shown in FIG. 1A will be referred to in this embodiment as the window control floor unit assembly or generally as the control floor unit assembly.

Figure 2:
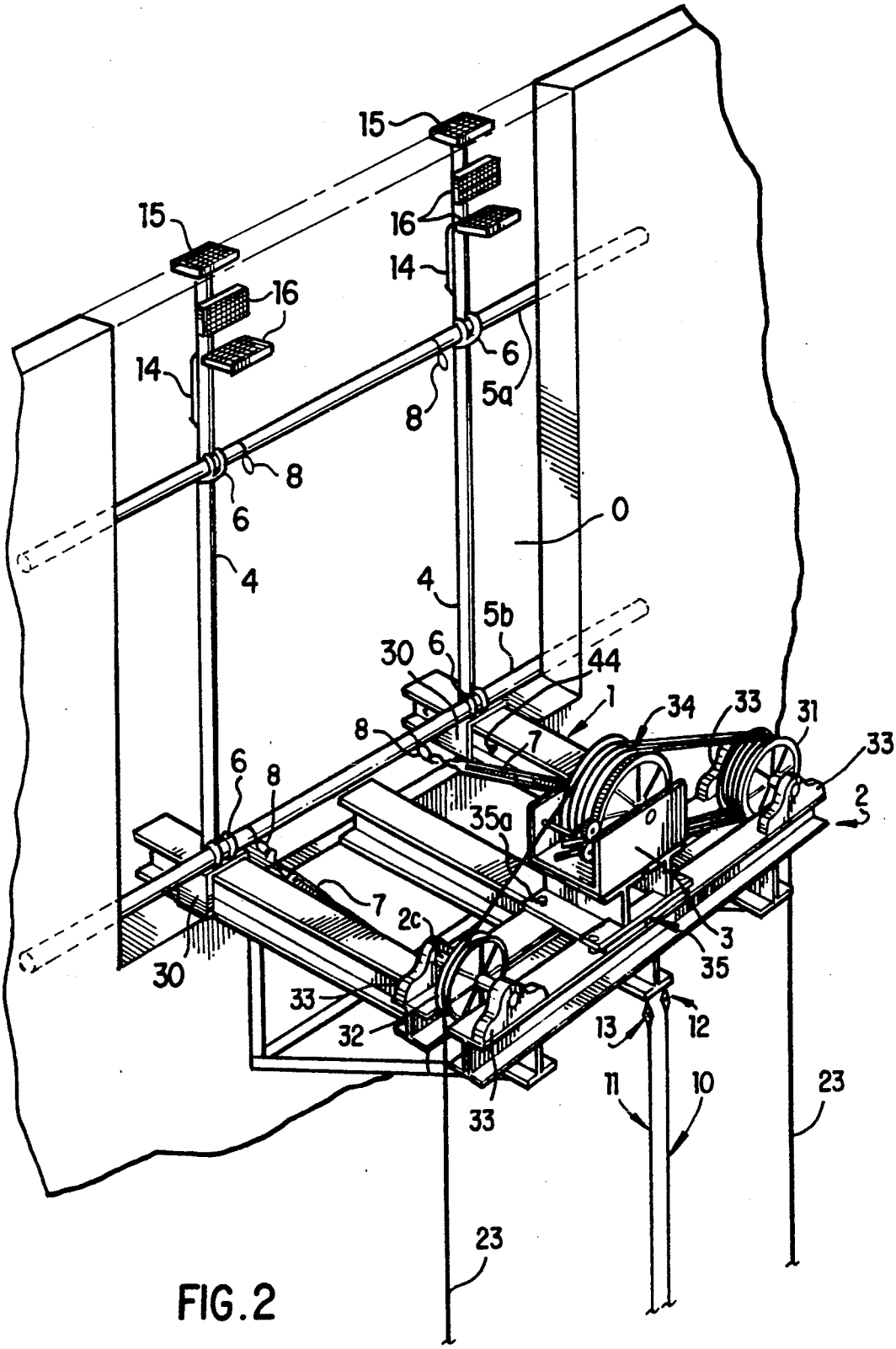
FIG. 2 is a detailed perspective view of the apparatus of FIG. 1A installed in an air shaft.

FIG. 2 illustrates another preferred embodiment of the assembly described above, as installed in an opening to an air shaft. In this embodiment, the top horizontal bar 5*a* rests and is secured in the channel of upper trail clamps 6 with the ends of bar 5*a* resting against and bearing upon an inside portion of the vertical sides of the air shaft opening 0. Bottom horizontal bar 5*b* rests and is secured in the channel of each lower trail clamp 30, also with the ends of bar 5*b* resting against and bearing upon an inside portion of the vertical sides of the airshaft opening 0. In this embodiment the trail clamps 30 are positioned on the trail ends of E-Frame 1.

Vertical bars 4 are shown in FIG. 2 placed in position by passing through each upper trail clamp 6 and resting each of their bottom ends in respective trail clamps 30, wherein the ceiling securing pads 15 are resting and bearing against a portion of the upper horizontal frame of the airshaft opening 0. As shown, auxiliary securing pads 16*a* and 16*b* are not employed in this embodiment.

Referring back to FIG. 1C there is illustrated an assembly similar to the window unit described above with all the same components less the I-Frame 2, but in place having E-Frame landing floor cross beam 28*a*, and which assembly has been installed in a window frame a distance below the window control floor unit assembly, for example, several building stories below, such as twenty or more stories or possibly sixty or more. This unit assembly shown in FIG. 1C will be referred to in this embodiment as the window landing floor unit assembly or generally the landing floor unit assembly. A window in a floor somewhere between the above described window control floor and window landing floor unit assemblies will be referred to in this embodiment as the window staging floor or generally the staging floor, which is illustrated in FIG. 1B. As shown in FIG. 1C, the E-Frame on the landing floor unit assembly is preferably fitted with a floor plate 29, such as a diamond grid floor plate or the like, to enable a tow line reel 23 and auxiliary reel 18, more fully discussed below, to be secured for the hoisting of cables and to land hoisting chains and for counterweight functions, and additionally for receiving cargo, all of which are discussed more fully hereinbelow.

In FIGS. 1A and 1C, guide rail extensions 10 and 11 are connected to respective rail connectors 12 and 13 which are in turn attached to a portion of the E-Frame 1, illustrated as an underside portion of the middle beam of E-Frame 1 in this embodiment. Connected to rail extensions 10 and 11 are auxiliary cables 17 and 18, respectively, positioned through respective cable guides 19 and 20 on the landing floor unit assembly and whereby auxiliary cable 17 is shown wound on reel 17*a*, preferably with detachable cable and shaft locks and handle, and auxiliary cable 18 is shown wound on reel 18*a*, equipped with a stand and handle.

As shown in FIG. 1B, no apparatus in accordance with this embodiment is installed on the staging floor, which is preferably chosen to be a loading location, for example, in close proximity to a perilous location such as a fire. The selection of the control floor for the window control floor unit assembly directly above the staging floor, as above-described, is therefore chosen carefully, for example, when fire rescue is involved, which is usually in a safe lane calculated to avoid flames. As will be apparent to persons skilled in the art there may be several staging floors for on-loading between control and landing floor unit assemblies.

The landing floor is one location where loading and unloading takes place. Suspended from one side of the I-Frame on the window control floor unit assembly, the left side as illustrated in this preferred embodiment, from pulley 31 is tow line 23 wound on large cable linker means 22, and with excess unused length of tow line 23 wound on reel 23*a*. Cable linker means 22 holds the tow line 23, wound on reel 23*a*, by the influence of gravity pull friction on tow line 23 by hanging reel 23*a*, which reel is locked.

Figure 6A:
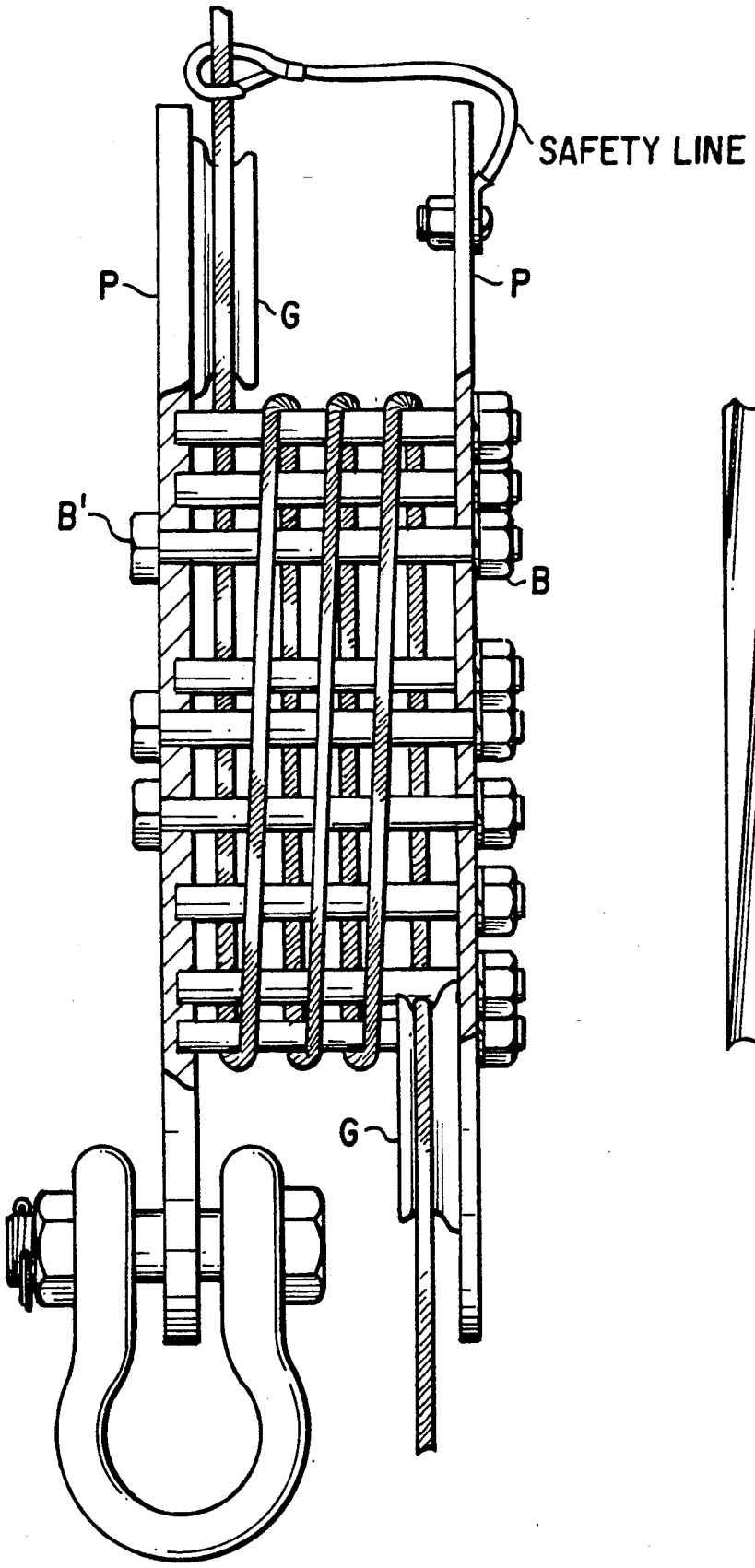
FIG. 6A is a detailed schematic side view of a preferred cable linker means for use with the hoisting and rescue apparatus of the invention.
Figure 6C:
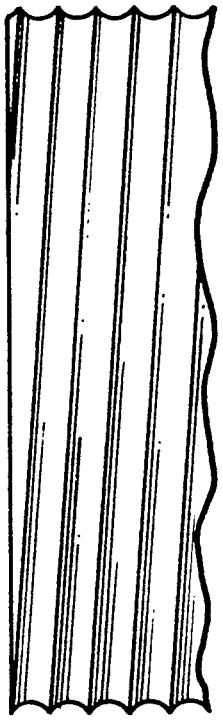
FIG. 6C is a detailed schematic view of an additional embodiment of a cable linker means for use in the apparatus of the invention.
Figure 6B:
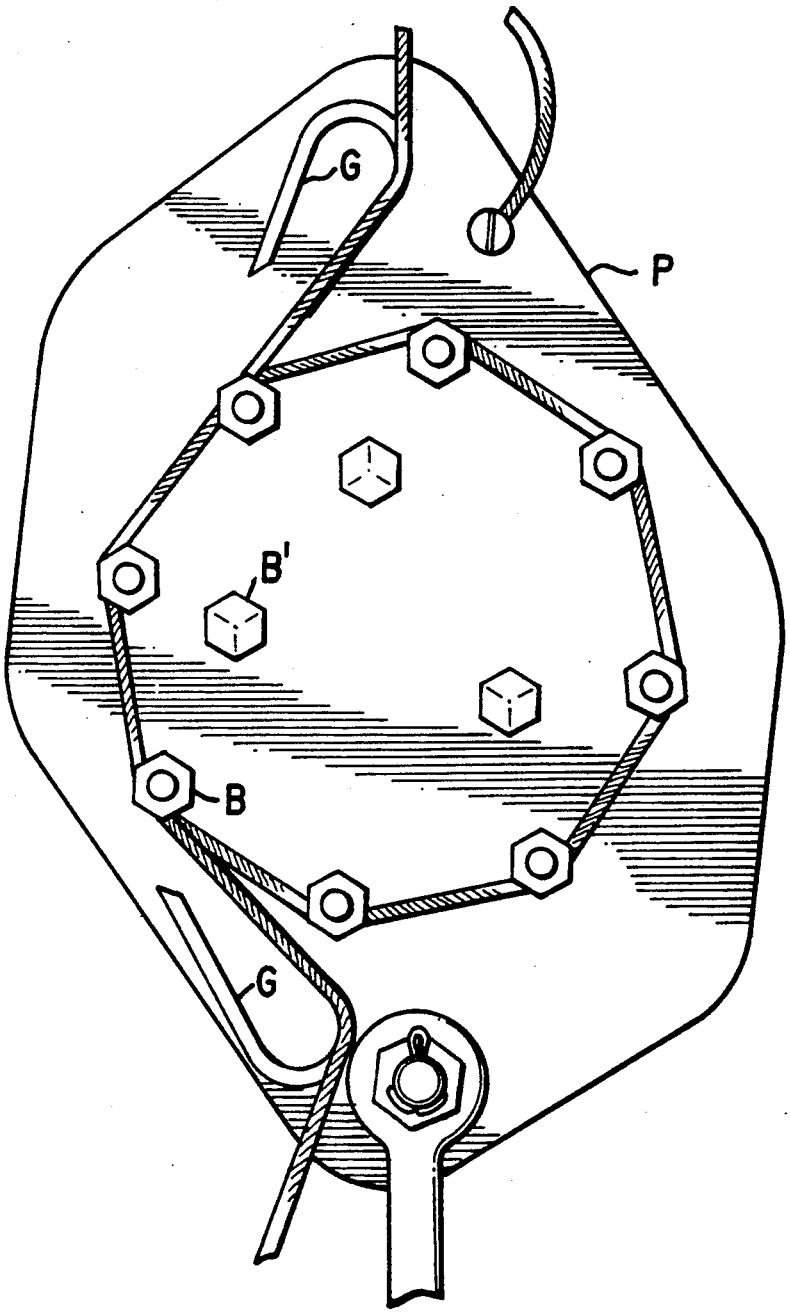
FIG. 6B is a detailed see-through schematic side view of the preferred cable-linker means of FIG. 6A.

A detailed illustration of a preferred cable linker means 22 is shown in FIGS. 6A and 6B, showing side and inside views respectively. The cable linker means 22 permits the connection of a load at any played out length of a wire rope or cable and suspends the unused portion of the cable on its reel out of the way without the need to be severed as shown in the preferred embodiments of FIG. 6A and 6B, by simply passing the cable against a guide "G" inside the cable linker means, preferably comprising a plurality of parallel drift bolts "B" situated between two side plates "P". As shown in the transparent side view 6B of preferred cable linker means 22, the drift bolts B can be arranged to form the periphery of a multisided shape, for example an octagon, oval or circle. The tow line cable 23, after passing through guide G is wound around the drift bolts B forming an octagon or an such as illustrated in FIG. 6A. As shown in 6B, drift bolts B' which the cable is not wound around, are holding the side plates "P" together. It is contemplate in the invention that cable linker means 22 such as above described can be made to accommodate any size cable or rope. It will be appreciated by persons skilled in the art that the preferred cable linker means 22 described above affords advantages of not kinking, bruising or otherwise damaging and weakening cables. If desired, a safety line can be installed as shown in FIG. 6A to a bolted position on a side plate P with an attachment to the cable wound thereon, such as a clevis hook or other snap hook assembly.

In a further embodiment, cable linker means 22 can comprise a grooved article of a one-piece cast construction, such as illustrated in FIG. 6C.

Referring now to FIG. 1B, a hoisting chain 24 of variable length is attached to a bottom portion of cable linker 22, for example, by a shackle means which is attached to a side plate P on the cable linker 22, such as illustrated in the preferred embodiment of FIG. 6*a*. At a desired position on the hoisting chain 24 is attached a counterweight container 25, for example, a drum, bucket or canvas container with suitable attachment means, such as an attachment hook. The counterweight container 25 also preferably has a guide rail attachment means 26, such as a hooked cable or a cable length with a karabiner which can be attached to auxiliary cable 18 which is attached to guide rail extension 10 as shown, to keep the counterweight container 25 from swaying or tilting undesirably as the counterweight container 25 is raised and lowered as discussed below. The counterweight container 25 is also preferably equipped with at least one valve 27, for example a ball valve, for quickly emptying the contents of counterweight container 25. The counterweight container 25 is preferably attached to the end of hoisting chain 24.

The hoisting chain 24 such as above described can be loaded with various types and shapes of cargo suitably attached thereto, and can be unloaded at any floor below the control floor, which can become a staging floor in accordance with this invention. Therefore, the hoisting chain 24 can be one or more stories in length and can serve to unload or to load cargo for descent from one staging floor or several staging floors to a landing floor when feasible and if required.

Figure 7:
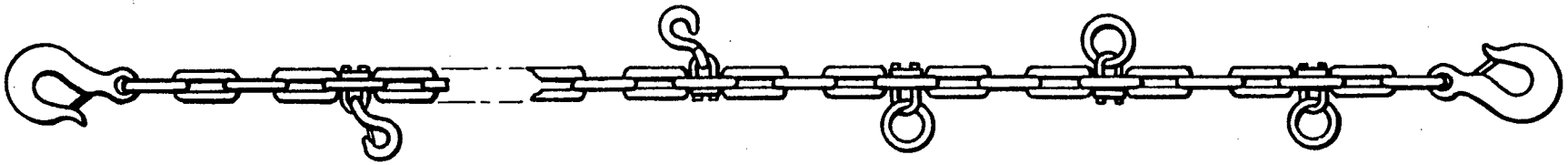
FIG. 7 is a detailed schematic view of a preferred embodiment of a hoisting chain for use in the apparatus of FIGS 1A, 1B, 1C.
Figure 8:
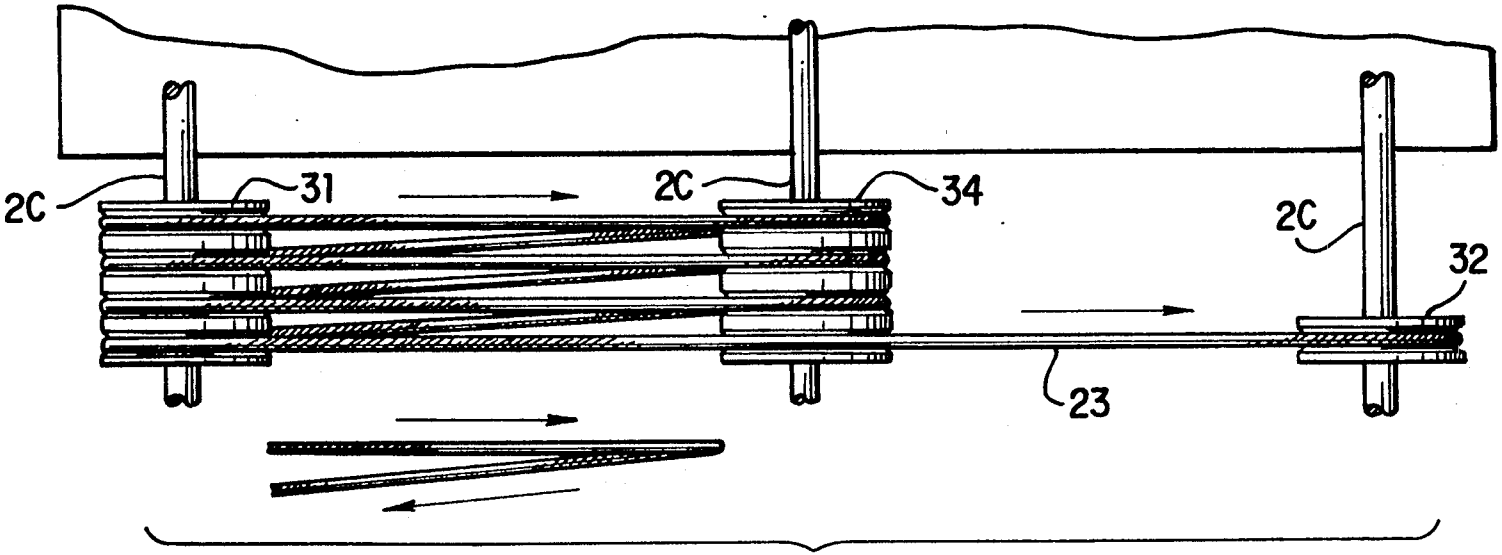
FIG. 8 is a plan view of a detailed schematic of components of the apparatus illustrated in FIGS. 1A, and 2.

A preferred embodiment of a hoisting chain for hoisting cargo and/or human rescue is illustrated in FIG. 7. The hoisting chain in FIG. 7 is shown in a broken view to illustrate variable length. The chain is also shown equipped with various attachment means such as anchored, snap or clevis and grab hooks and rings or karabiner. It will be appreciated by persons skilled in the art that cargo containers or articles including human rescue apparatus with appropriate attachment means can be attached at various points on the hoisting chain, including multiple pieces of cargo or for example, human rescue apparatus. Factors which can determine the length of the hoisting chain 24, include, for example, the number of people to be moved, and how many floors of a building are to be utilized simultaneously, and the assignment of an equivalent number of evacuation floors from which people can be evacuated. As further shown in the composite of FIGS. 1A, 1B and 1C, the end of tow line 23 opposite the end attached to cable linker means 22 and hoisting chain means 24 as above described is wound around the four groove, pulleys 31 and 34 four times each and then once over pulley 32 to suspend therefrom (on the right side of the I-Frame on the control floor unit assembly as illustrated in this preferred embodiment). The tow line 23 thus wound around the arrangement of pulleys as described and suspended is shown in the composite of FIGS. 1A, 1B and 1C reaching down past one or more staging floors to have an end in close proximity to the window landing floor unit assembly in FIG. 1C. The tow line cable 23 as wound through pulleys 31, 34 and 32 in the above-described arrangement is illustrated in detail in the plan view of FIG. 8. As shown in FIG. 8, the cable is preferably in an angled return arrangement on the underside of four groove pulley 34 to the underside of pulley 31 to offset the return of the cable from pulley 34 to a groove in an adjacent lane in pulley 31. As further shown, the top side communication of cable between pulleys 31 and 34, in this preferred arrangement, is in the same lane. The tow line cable 23 thus installed through pulleys 31, 34 and 32 can move in either a left or right direction, subject to stoppage via the action of pawl 47 on pulley 34 and the influence of friction brake 46, as described in detail above.

The end of tow line cable 23, as illustrated in FIG. 1C is shown attached to a second counterweight container 25'. This counterweight container 25', in like manner as container 25, is preferably equipped with a guide rail attachment 26' to be attached to auxiliary cable 17 which is attached to guide rail extension 11, and when container 25' is hoisted vertically upward. by attached tow line cable 23, to keep the container from swaying or tilting. The second counterweight container 25, also is preferably equipped with a valve 27 for emptying the contents of the container.

In a preferred embodiment of this invention, as illustrated in FIG. 1C, and further in the detail of FIGS. 9 this end of the tow line cable 23 is fitted with a plurality of spaced lugs 120, and is positioned and wound through a tow line connector means 36, preferably of a design illustrated in FIGS. 9.

Figure 9A:
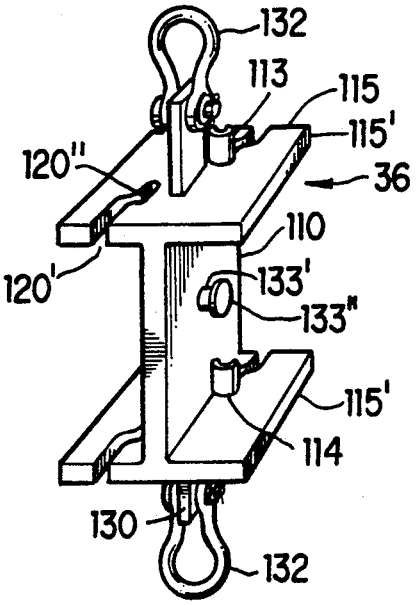
FIGS. 9A–9F are detailed perspective views of a preferred connection means for use with the hoisting and rescue apparatus of the invention.
Figure 9B:
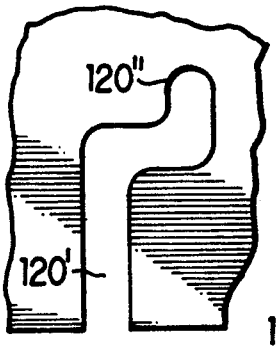
Figure 9C:
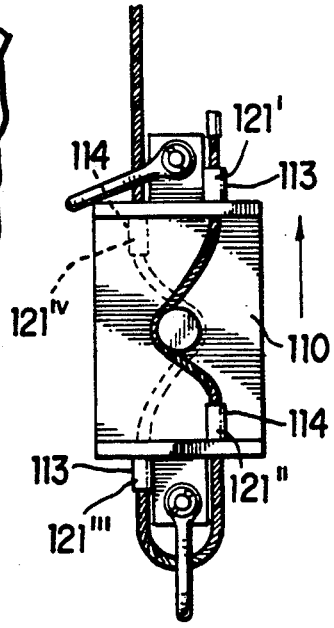
Figure 9D:
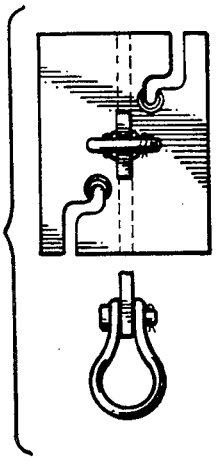

As shown in FIG. 9A, the preferred tow line connector means 36 is in the configuration of a segment of an I-beam having a longitudinal body portion 110 with integral end portions 115 at right angles to the body portion 110. Thus, each end portion 115, where not at an integral juncture with the body portion 110, have free end portions 115', providing a total of four free ends. As further shown in FIG. 9A and 9B, each free end defines a flat portion of the I-beam configuration, and contains a slotted opening 120 therein in the form of an "S" shape, with the open end portion of the slot 120, being of greater length than the closed end portion of the slot 120''. The "S" shaped slots 120 are arranged in the free ends 115 so that each closed slot end portion 120'' is parallel and adjacent to the body portion 110 which is at a right angle to each closed slot end 120''. Further, each open slot end 120' is arranged to be approximately in the center of each of the four free end portions 115'. Protruding at right angles from approximately the center of each end portion 115 approximately in line with the body portion 110 are attachment ends 130, shown in FIGS. 9A, 9C and 9D with shackles 132 attached to each end 130. Also, in a center of body 110 is situated a post 133 at a right angle to the body 110 with free ends 133' protruding from each side of the body portion 110, with each protruding free end 133' capped with an enlarged portion 133'' in the shape of a bolt head. The bolt head portion 133'' is preferably of a rounded knob configuration to facilitate easy passage or slippage of a cable portion thereover without damage to the cable.

Figure 9E:
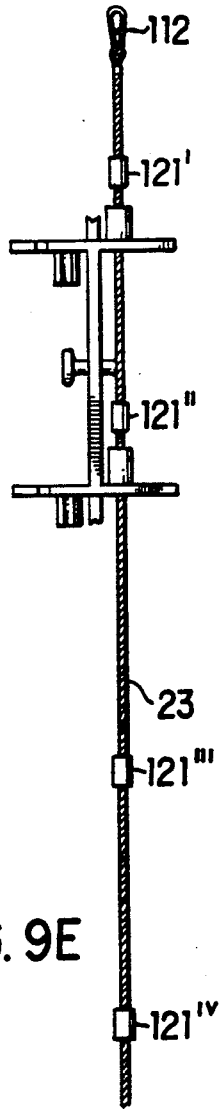
Figure 9F:
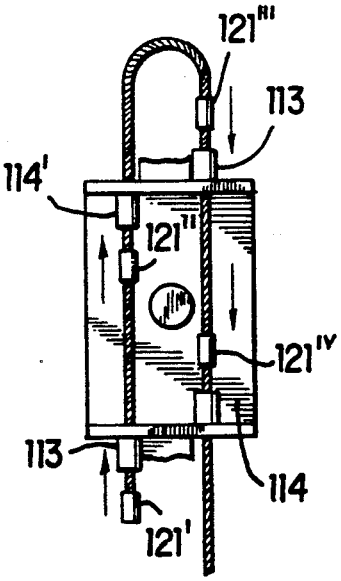

As further shown in the detail of FIG. 9E, the end of tow line cable 23 can be fitted with at least four lugs 121. The tow line 23 thus fitted with lugs 121 can be mounted in tow line connector 36, starting at either of free ends 115'. The end of cable 23 is also preferably fitted with a slender connector means 112, for example, a fish spring lock. Referring now to FIG. 9F, in mounting cable 23 in tow line connector means 36 the cable end with slender connector means 112 is started with the first two lugs $121^{I}$ and $121^{II}$ in substantially a straight line, with the first lug $121^{I}$ entering an external receptacle 113 on the outside portion of a free end 115', and which is located at the closed end portion of a slot $120^{II}$, and the second lug $121^{II}$ entering an internal receptacle 114 on the inside portion of a free end 115', also located at the closed end portion of a slot 120''. When aligned, the first and second lugs, $121^{I}$ and $121^{II}$ are pulled securely into their respective receptacles 113 and 114, and a slacked portion of cable 23 between the first and second lugs $121^{I}$ and $121^{II}$ is pressed or otherwise slipped over the bolt head 133''. The cable 23 is then looped around the outside of free ends 115' opposite the free end 115' from where mounting tow line 23 commenced, and the remaining cable lugs, the third and fourth lugs, 121$^{III}$ and 121$^{IV}$ are introduced in the manner set forth above with third lug 121$^{III}$ entering an external receptacle 113 on an outside portion of free end 115' located at the closed end portion of a slot 120' (a free end 115' diagonally opposite to the initial mounting free and 115' ), and the fourth lug 121$^{IV}$ entering an internal receptacle 114 on the inside portion of a free end 115' located at the closed end portion of a slot 120''. When aligned, the third and fourth lugs 121$^{III}$ and 121$^{IV}$ are pulled securely into their respective external and internal receptacles 113 and 114 and a slacked portion of cable 23 between the third and fourth lugs, 121$^{III}$ and 121$^{IV}$ is slipped over bolt head 133'', and the tow line connector means 36 with now mounted and attached tow line cable 23 is ready to hoist. As will be noted from the above description, the tow line connector means 36 can be mounted by a cable from either end, and thus each free end 115' has an external receptacle 113 and an internal receptacle 114, each situated at the closed end portion of a slot 120. The open ends of the slot 120' of course provide entry of the cable 23 and lugs 121 to the receptacles.

Generally, when the end of a mounted cable is pointing in an upward or downward direction, a load can be attached to shackle 132 on the opposite end of the connector means 36 for bringing loads up or down. When the cable end is pointing in a downward direction, (FIG. 6F) and the shackle 132 above is connected, the connector 36 will hoist up a mounted cable.

It will be appreciated by persons skilled in the art that a tow line connector means 36, and the preferred embodiment illustrated in FIG. 9 in particular, permits cables to be utilized without causing stress or damage to cable ends, for example, when hauling heavy loads.

As shown in FIG. 1C, the second counter weight container 25' is attached to a shackle 132 on the tow line connector 36.

Figure 11:
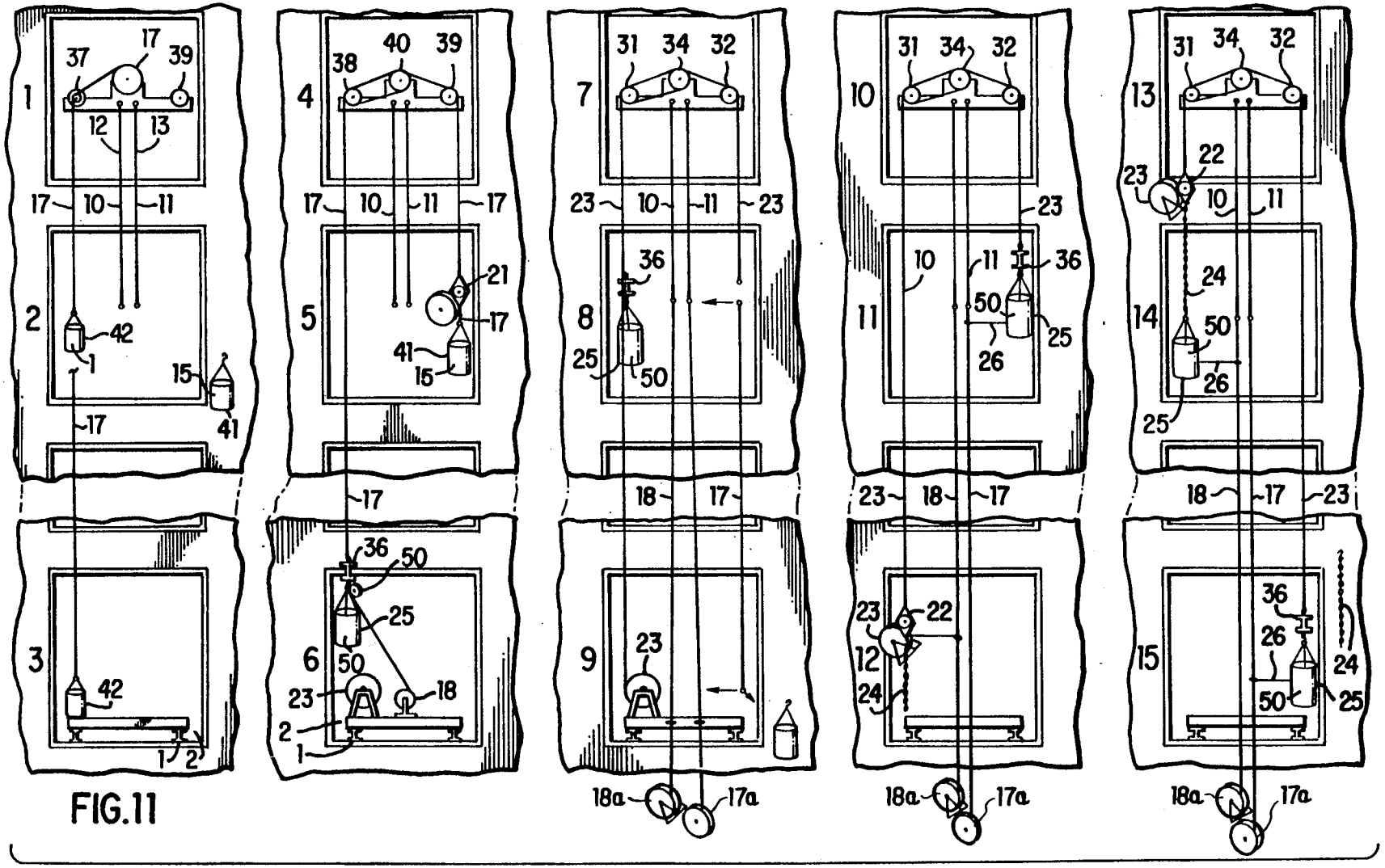
FIG. 11 is a detailed schematic view of the progression of various stages of installation of a preferred embodiment of the apparatus of this invention as illustrated in the composite of FIGS. 1A, 1B and 1C.
Figure 12:
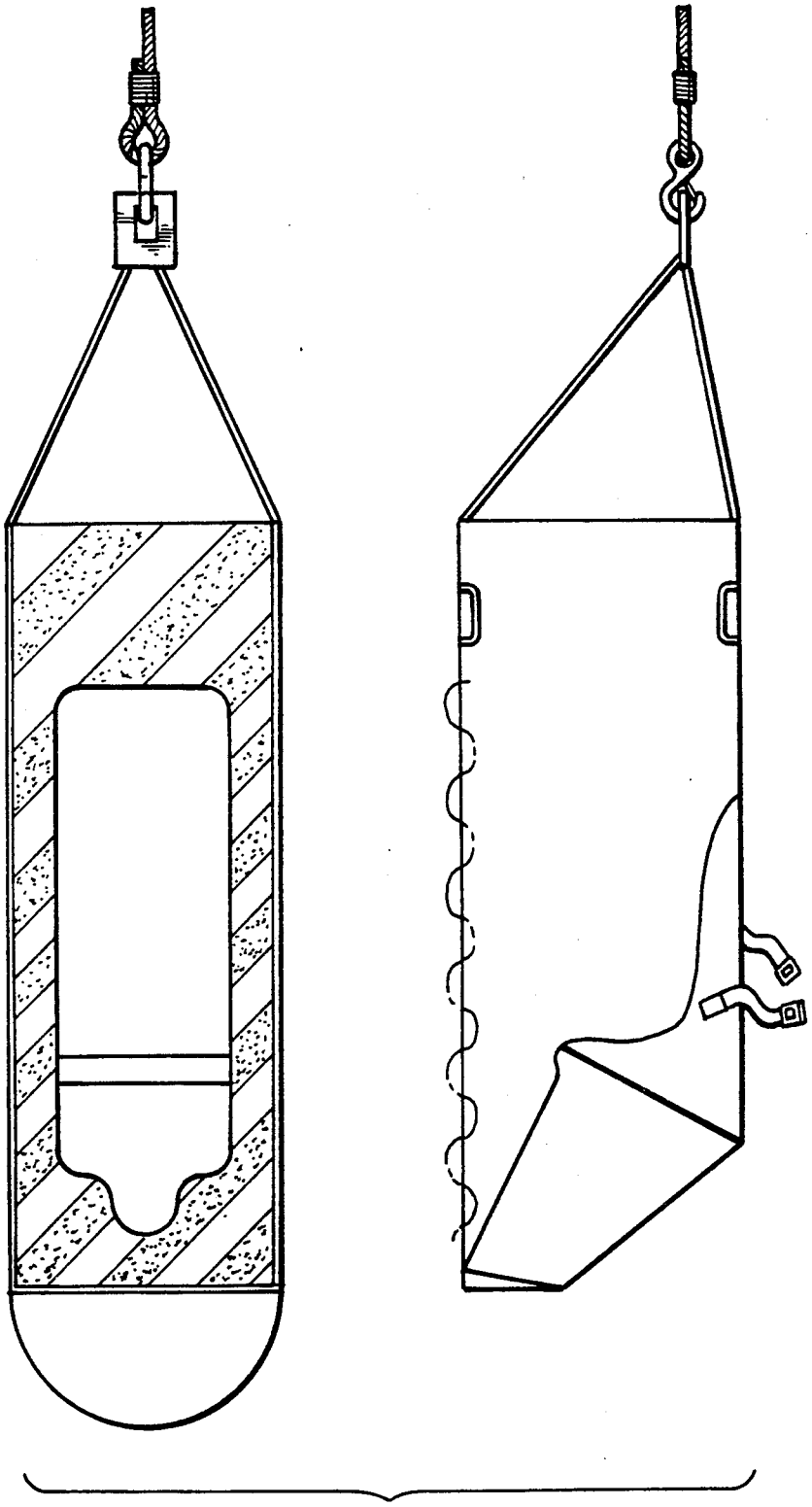
FIG. 12 is a detailed schematic view of an example of a human rescue apparatus which can be used with the apparatus of the invention.

The apparatus of the invention, in this preferred embodiment, now installed can be easily operated, for example, after attaching a load to a portion of the hoisting chain 24 at a window staging floor and by adding a desired amount of a counterweight substance, for example, water to a second counterweight container 25' attached as shown in FIG. 11, frames 14 and 15, with an empty hoisting chain 24 also attached and situated proximate to the floor unit assembly, as shown in FIG. 1C and FIG. 11, frame 15. By the operation of the pawl means 46 allowing free movement of pulley 34 in the control floor unit assembly, the cargo attached to chain 24, which in turn is in attached communication with tow line cable 23, can now move freely in a downward position by gravity, an the rate of descent thereof controlled by the action of brake means 46. In the preferred embodiment illustrated in the composite of FIGS. 1A, 1B and 1C, the cargo on the hoisting chain 24 in lowered to the landing floor and discharged. Simultaneously, second counterweight container 25', filled to a desired weight with counterweight substance, for example, an amount of water calculated to offset the load weight of descending cargo attached to chain 24 and to facilitate control of the rate of descent of said cargo load, rises upwardly to the staging floor level, where it can be drained, and hoisting chain 24 reloaded with cargo for a rapid return decent of an empty counterweight container 25', and in turn raising the tow line cable 23 on the side connected to container 25, and the other hoisting chain 24 and to bring up container 25 for chain to take on another load to be brought down for discharge at the landing floor unit assembly. As discussed above, the containers 25 and 25', in traveling up and down in operation the apparatus of this invention, are attached to cables 17 and 18 and 11 and 10 to prevent swaying and/or tipping of the containers at points between the control floor and landing floor unit assemblies.

Installation of the Hoisting and Rescue Apparatus and the Auxiliary Feature

The tow line 23 can be installed in several ways. In a preferred embodiment, the auxiliary feature of this invention permits rapid and convenient installation of a tow line 23 in a semi-automatic manner, for operation of the hoisting and rescue apparatus in accordance with this invention, and to place vital cargo and a constant flow of equipment at the scene of apparatus assembly, which avoids the undesirable and dangerous alternative of carrying the tow line 23 and other very heavy and oversized equipment to a control or staging floor. The following description will alternate from floor to floor, i.e., window control floor, staging floor and landing floors, as the performance of each operation is described in detail below.

First, in installation of a window control floor unit assembly such as illustrated in the embodiment of FIG. 1A, it is contemplated that a portable I-Frame 2 of sufficiently light construction, for example of carrying weight by one or more team personnel, is bolted to a portable E-Frame 1 also of sufficiently light carrying weight construction, after the E-Frame 1 has been lowered into position using the guide rail connectors and after attaching both hooks 7*a* into eyes 8 of horizontal bar 5*b* with the backframe resting and bearing against the face of a building below the lower horizontal sill portion of a window from which the E Frame-1 is protruding, and after vertical and horizontal bars 4 and 5 have been installed, and turnbuckles 7 have been connected to horizontal bar 5, such as in the manner described hereinabove. A quick choice of the use of ceiling pad 15 or either auxiliary pads 16*a* or 16*b* is made and the positioning of the vertical bars 4 and a lower horizontal bar 5*b* below window level or at flood level, for example, if in an air shaft, is accomplished, then tightening all connection points of bars 4 and 5, turnbuckles 7, and finally connecting both left and right rail guide extension cables 10 and 11 to their respective connectors 12 and 13 and left dangling, is completed, such as described above.

Figure 10:
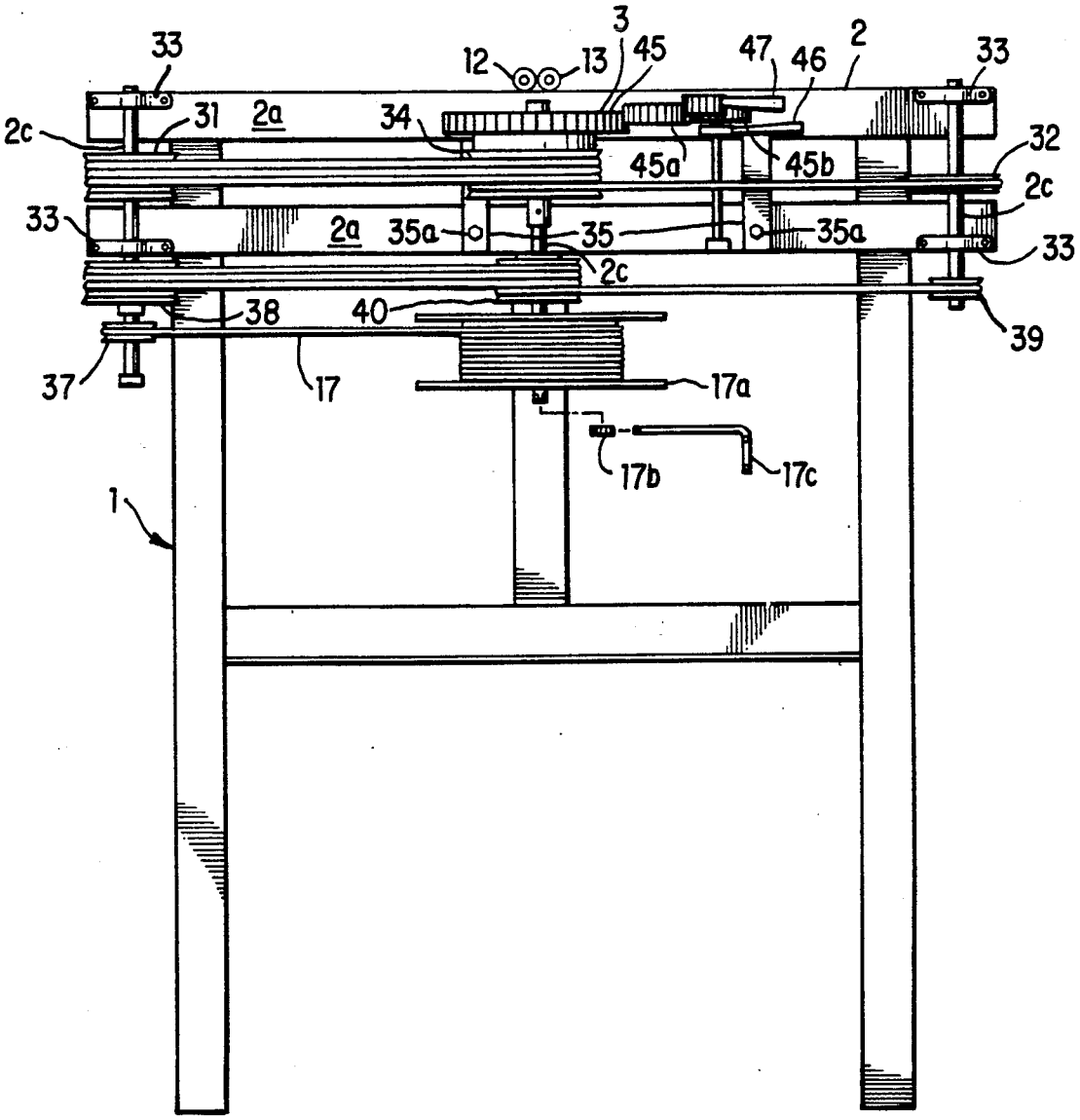
FIG. 10 is a detailed schematic view of the portable apparatus of this invention with auxiliary features in conjunction with other components of FIG. 1A.

Referring now to FIG. 10, there is illustrated a schematic of a plan view of a control apparatus comprising an E-Frame 1, I-Frame 2, capstan 3 with friction brake 46 and pawl control 47 and pulleys 31, 34 and 32 on respective shafts 2C.

In the auxiliary unit installed, for example, on a portable control apparatus such as illustrated in FIG. 10, pulleys 31 and 32 are equipped with extended shafts 2C which afford the installation of the three auxiliary pulleys 38, 39 and 40, with pulleys 38 and 40 having four grooves and pulley 39 having a single groove. For most purposes contemplated for use by this invention, the auxiliary pulleys are preferably four inches, with four groove pulleys 38 and 40 being of the same size. As shown in the FIGURE, all the auxiliary pulleys are fixed to their respective shafts. In the preferred embodiment of FIG. 10 ,the left side of the apparatus is fitted with four groove pulley 38 on shaft 2C behind pulley 31, and an identical four groove auxiliary pulley 40 is fitted on capstan shaft 2C behind the capstan pulley 34. On the right side, a shaft 2C is fitted with an auxiliary single groove pulley 39 behind pulley 32. The auxiliary pulleys can be held in position with steel collars, and the grooves are relative to cable dimensions used. An auxiliary cable 17 wound on reel 17*a* is inserted on shaft 2C behind auxiliary pulley 40 and in direct operational communication with capstan 3, and the effects of pawl 47 and brake 46. A reel lock 17*b* is set behind reel 17*a* on shaft 2C thereby locking reel 17*a*. A free-wheeling spinning cable guide 37 is also fitted on shaft 2C behind pulley 38 and held to its confines by adjustable steel collars.

the auxiliary cable 17 can be a wire rope cable, preferably of dimensions 3/32"7×19 IWRC, weighing approximately 16 lbs. per thousand feet, and having a breaking strength exceeding 1000 lbs. In this illustrative embodiment cable 17 is wound on reel 17*a* clockwise which permits reel 17*a* to unwind over the top of reel 17*a* (from right to left in FIG. 10). Referring to FIG. 10 and additionally to FIG. 11, auxiliary cable 17 is preferably equipped with a steel thimbled end, and ample footage of the cable calculated to reach a lower staging floor beneath the control floor unit assembly, for example about ten feet, are placed over the cable spinning guide 37 and permitted to dangle down to the staging floor. The pawl 47 is set in a neutral state allowing free-wheeling of shaft 2C on capstan 3, and pulley 37 with auxiliary cable 17, which movement can be controlled via friction brake 46. See Frame 1, FIG. 11. Next, for example, by the action of an operator on the staging floor, a counter weight container 42 is attached to the end of auxiliary cable 17. The container 42 can be of any size, but for most purposes a one gallon size is generally sufficient. Counterweight container 42 is preferably attached with a snap-on (snap-off) device, which devices are also preferably employed where possible throughout the apparatus of this invention and in method of use and operation thereof. When desired, for example, after operators on the control and landing floors are signaled, the auxiliary cable 17 with attached counter weight container 42 are then lowered away to drop the auxiliary cable as many stories below to a landing floor in a very short time, for example, in a matter of second. See, Frame 3, FIG. 11. An operator on the landing floor can signal the arrival of the counterweight container 42, for example, by flashing light means, to provide ample braking time for a safe landing. Other indicating means can also be employed such as reflective tape, attachable lights, and the like, when operating in night time conditions, blackouts or in a dark shaft each in support of constant radio communication.

Upon safe arrival of counterweight container 42, and certain that the position of the control floor is directly above in substantially the same perpendicular lane when in sue on a building facade, operators on a designated landing floor which can be ground level or at any building story above ground level, install the landing floor unit assembly, described hereinabove and illustrated in FIG. 1C, with E-Frame landing floor and attached floor plate 29. In another aspect of this invention, the landing floor can be simultaneously installed in the same lane. Tow line 23 wound on tow line reel 23*a*, and second auxiliary cable 18 wound on reel 18*a* are then clamped or otherwise attached onto a portion of landing floor plate 29 or some other desired portion of the landing floor unit assembly, and the landing floor awaits arrival of the thimbled end of first auxiliary cable 17 and the counterweight container 42. A tow line 23 cable end is set or otherwise attached to a tow line connector means 36 (described in detail hereinabove) and upon arrival of first auxiliary cable 17 thimble end at the landing floor, counterweight container 42 is removed, and tow line connector means 36 with attached tow line 23 with a threader cable 50 attached to a portion thereof is attached to the thimbled end of the auxiliary cable 17. The end of second auxiliary cable 18 is attached to a bottom portion of tow line connector means 36. At this point hoisting installation operations from the landing floor are ready to commence. See, Frame 6, FIG. 11.

At the control floor level sufficient slack of first auxiliary cable 17 is pulled off auxiliary cable reel 17*a* from shaft 2*c* after unlocking reel 17*a*, and the slack is placed over the single groove pulley 39 and the first auxiliary cable 17 and reel 17*a* are lowered to a staging floor below. Additional slack of cable 17 is then wrapped around auxiliary pulleys 38, 39 and 40. This is accomplished, for example, by an operator lifting the first auxiliary cable 17 off free-wheeling pulley 37 and wrapping the slack of this cable four times each around four grooved pulleys 38 and 40 and then locking first auxiliary cable reel 17*a* via a karabiner located on holes of reel 17*a*, to prevent reel 17*a* with remainder of first auxiliary cable 17 wound thereon form unwinding. See, Frames 4 and 5, FIG. 11. At the staging Floor, a cable linker means 21 (such as described in detail hereinabove) is attached to a portion of the first auxiliary cable 17 just prior to where cable 17 begins to be wound on reel 17*a*, to suspend cable reel 17*a* containing an unused portion of cable 17. Further, on the staging floor, an auxiliary counterweight container 41 is then connected to the shackle portion of cable linker means 21. See, Frame 5, FIG. 11. At the control floor, the pawl 46 is placed in neutral to allow a state of free wheeling while applying friction brake 46 on capstan 3. At the staging floor, the auxiliary container 41 is filled with water, and ten lowered with attached reel 17*a* with cable 17 and cable linker means 21 to the landing floor while controlling the descent by friction brake 46 on the control floor. While the above operation proceeds, simultaneously the first auxiliary cable 17 dangling from the single groove pulley 39 on the opposite side of the apparatus rises, brining up attached tow lines 23 and tow line connector means 36, threader cable 50, an empty counterweight container 25, and a portion of second auxiliary cable 18 as it unwinds from second cable reel 18 for the desired length thereof thereby leaving the unused balance of tow line cable 23 and second auxiliary cable 18 on their respective anchored reels. Unwound tow line cable 23 and second auxiliary able 18 and other attachments described above thus are hoisted via the rising action of first auxiliary cable 17 to the staging floor. See, Frames 6, 7 and 8 of FIG. 11.

At the staging floor, upon arrival of the hoisted tow line cable 23 and second auxiliary cable 18 with above-described attachments, the end of second auxiliary cable 18 is detached from the tow line connector means 36, and then attached to the end of guide rail extension 10. The counterweight container 25 is then detached and placed aside for the moment. Next, threader cable 50 also hoisted up is removed or detached from its mooring, for example, from a position on tow line connector means 36 or from inside container 25, and wound through pulleys 31, 34 and 32; four times around pulleys 31 and 34 and once over pulley 32. The threader cable 50 is equipped with a lug 20*a* at a portion near one of its ends which is set in respective restraining slot 51 on the right side of I-Frame 2 to prevent the threader cable 50 from slipping through wound over pulleys, to hold the tow line. The other end of threader cable 50 is equipped with a thimbled end overhanging to the staging floor which is connected to counterweight container 25. Counterweight container 25 can be partly filled with a counterweight substance, such as a calculated amount of water. Next, the free end of the threader cable 50 is attached to the free end of tow line able 23 via, for example, a slender cable connector on the threader cable 50, with a the free end of the to line 23 equipped with an appropriate connector means to make this connection. The auxiliary cable 17 is then detached from the shackle of the tow line connector means 36, and the free end of auxiliary cable 17 si then connected to guide rail extension 11. See, Frame 7 and 8, FIG. 11. The auxiliary cable is then removed from the auxiliary pulleys 38 and 40 and auxiliary cable 17 is permitted to hang freely. Next handle 17*b* is installed on capstan 3, shaft 2*c*, and the tow line cable 23 attached to the threader cable 50 is cranked, pulled or otherwise caused to go over and around pulleys 31, 34 and 32 of the cargo hoisting and rescue apparatus of the invention. At the staging floor level, the threader cable 50 is guided down with the end of tow line cable 23 attached, and the tow line cable 23 is connected to tow line connector means 36, which is already attached to counter weight container 25. See, Frame 11, FIG. 11. The threader cable 50 is then detached and put aside, or otherwise stored. Any water in the counterweight container 25 is drained and the container set in the air space ready to be filled, and container 25 hanging from the tow line connector means 36 is attached to cable 17 with guide rial 26.

During the above operation, the movement of the tow line cable 23 is controlled via brake 46 and pawl means 47 at the control floor level.

Upon arrival of the auxiliary counterweight container 41 at the landing floor, the container is drained, detached from cable linker 21 and counterweight container 41 is put aside. The first auxiliary reel 17*a* and cable 17 is passed and dangled through cable guide 19 to hang free. See, FIG. 1C. The second auxiliary reel 18 with auxiliary cable 18 is unclamped from its position on the landing floor assembly unit, for example, the floor plate, and cable 18 is locked in reel 18*a*, an set in cable guide 20, and reel 18*a* permitted to hang free. A person skilled in the art will recognize that the above procedure not only stores cables 17 and 18 when not in use, but eliminates the need for take down of the cables, and empowers the use of auxiliary cables 17 and 18 as guide wires, kept taught and tensioned by the weight of reels 17*a* and 18*a* with unused auxiliary cable wound thereon.

At the landing floor assembly unit, the tow line cable 23 and reel 23*a* with its stand is unclamped from its position, the cable 23 locked, and a heavy duty cable linker means 22 (preferably of the design described hereinabove) is installed and adjusted. Hoisting chain 24 is then connected to the cable linker means 22 and empty counterweight container 25′ connected to the end of the hoisting chain 24. See, frames 12 and 14, FIG. 11. At this point in accordance with this preferred embodiment of the invention, for most purposes, given practical limits of materials of construction, it is contemplated that a weight of approximately four hundred pounds of equipment can be attached to the hoisting chain 24 (assuming the use, for example, of a fifty gallon capacity counterweight container) for raising and hoisting up to a desired location. An additional hoisting chain can be preloaded with additional equipment to be standing by for subsequent hoisting up to the desired location. See frame 15, FIG. 11. At this point, operations on the control and staging floors are ready to commence and can be signaled from the landing floor. See, frame 11, FIG. 11. At the staging floor, counterweight container 25 is filled with water, and is ready to descend. See, frame 11, FIG. 11. At the control floor unit assembly, the brake 46 is operated allowing filled container 25 to descend at a desired rate, thereby raising tow line cable 23 and hoisting chain 24 with attached equipment to the staging floor wherein the brake 46 is applied to slow the ascent of hoisting chain with attached cargo to a stop, permitting the equipment raised by the hoisting chain 24 to be unloaded on the staging floor. See, frame 14, FIG. 11. In the meantime, counterweight 25 has descended to the proximity of the loading floor unit assembly.

At the control floor the brake 46 is applied and stops the tow line 23 from moving permitting the staging floor to unload. A drain hose is connected to the counterweight container 25 and it is drained. FIG. 11, frame 15. The landing floor disconnects the counterweight container 25 and attaches the second hoisting chain 24 and equipment and reattaches the counterweight container 25 at the tailend of the hoisting chain 24.

The landing floor announces it is ready and stands by to load equipment for the next hoist in a possible series of loads within minutes or the time it takes to load and unload the hoisting chains 24, since the hoist time for even 100 stories is completed in a matter of seconds.

It is also contemplated in this invention that a heavy duty E-Frame and I-Frame control floor unit can be installed below an installed portable control floor and above a staging floor or floors that require evacuation.

What is claimed is:

1. A hoisting and rescue apparatus comprising (a) an E-Frame having three spaced apart parallel beams with the two outside beams connected at their respective ends to two support beams extending angularly downward in the same direction, and with downwardly extending ends of the support beams connected to two vertical support beams which are connected a their respective upper and lower ends to upper and lower horizontal support beams at right angles to the vertical support beams, and where portions of the upper horizontal support beam are integral with respective portions of the three spaced parallel beams;

(b) an I-Frame having two spaced apart parallel beams and connected to each other by one or more I-Frame transverse support beams, where the spaced parallel beams of the I-Frame are attached by portions thereof at right angles to portions of the parallel beams of the E-Frame, with the attached portions of the outer parallel I-Frame beam attached to E-Frame beam ends which are attached to the angularly downwardly extending E-Frame support beams;

(c) three pulley means attached to the upper portion of the I-Frame, wherein a first single grooved pulley means is attached to one end portion of the I-Frame and a second multiple-groove pulley means is attached to the opposite end portion of the I-Frame and a third multiple-groove pulley means is attached to a middle portion of the I-Frame by means of a capstan support, and wherein the first, second and third pulley means are positioned to allow a length of cable to pass from the first pulley means to the third pulley means and from the third pulley means to the second pulley means;

(d) a braking means effective to stop and control the speed of the third pulley means and a pawl means effective to hold the movement of the third pulley means;

(e) two spaced apart parallel vertical support bars with portions thereof connected at right angles to the outer parallel beams of the E-Frame, wherein the upper end portion of the vertical support bars have a window, ceiling or sill attachment means;

(f) two spaced apart parallel horizontal support bars attached at right angles to the vertical support bars forming two upper parallel spaced apart vertical support bar and horizontal support bar intersections and two lower parallel spaced apart vertical support bar and horizontal support bar intersections, and wherein at least one of the upper or lower intersections are connected to trail ends of the outer parallel beams of the E-Frame which are opposite to the ends connected to the I-Frame;

(g) two tensioning means connecting a portion of the outer parallel beams to a portion of the horizontal support bar forming an intersection which is connected to the trail ends of the outer parallel beams of the E-Frame, said tensioning means effective to tighten the connections at the upper and lower intersections.

2. The hoisting and rescue apparatus of claim 1, wherein said apparatus is protruding outside a window or into an air shaft with portions of either ends of the vertical support bars and horizontal support bars forming an interference fit with portions of the window frame or air shaft opening and the vertical and upper and lower horizontal support beams of the E-Frame are bearing against a portion of building below the window or air shaft.

3. The hoisting and rescue apparatus of claim 2, further comprising a cable passing through the grooves of the first, second and third pulley means on the I-Frame with each cable end suspending downwardly from the first and third pulley means, and wherein each cable end can be operatively moved upward or downward by spinning action of the first, second and third pulley means, and the rate of movement controlled by the braking means and/or pawl means.

4. The hoisting and rescue apparatus of claim 3 wherein each of the cable ends of cable length suspended from the first and third pulley means is connected to a first and second counterweight container effective to operatively move the cable ends upward or downward by gravity force.

5. The hoisting and rescue apparatus of claim 4 wherein the end of cable length suspended from the first and/or third pulley means is attached to a hoisting chain means having said respective counterweight container attached thereto, and wherein the hoisting chain means has one or more attachments for cargo which can be raised up or lowered down in response to upward and downward movement of the cable end.

6. The apparatus of claim 5 further comprising a reel wound with a length of said cable end suspended from said first or third pulley means, and wherein said reel is prevented from unwinding by the action of a cable linker means, and wherein said hoisting chain means is attached to a portion of said cable linker means.

7. The apparatus of claim 6 wherein said cable linker means connects the first or second counterweight container directly or indirectly attached to a portion thereto to a portion of said cable length suspended from the first or third pulley means.

8. The apparatus of claim 7, further comprising parallel first and second guide wire cable extending downwardly a distance from a portion of the I-beam to respective first and second guide wire reels immobilized at the end of the distance.

9. The apparatus of claim 8 wherein the first and second counterweight containers are attached to the first and second guide wire cables by respective guide wire extension means o hold the containers in a substantially straight line while being raised or lowered.

10. A hoisting and rescue apparatus having a first and second stage,

I. wherein the first stage comprises, (a) an E-Frame having three spaced apart parallel beams with two outside beams connected at their respective ends to two support beams extending angularly downward in the same direction, and with the downwardly extending ends of the support beams connected to two vertical support beams which are connected at their respective upper and lower ends to upper and lower horizontal support beams at right angles to the vertical support beams, and where portions of the upper horizontal support beam are integral with respective portions of the three spaced parallel beams;

(b) an I-Frame having two spaced apart parallel beams and connected to each other by one or more I-Frame transverse support beams, wherein the spaced apart parallel beams of the I-Frame are attached by portions thereof at right angles to portions of the parallel beams of the E-Frame with the attached portions of the outer parallel I-Frame beam attached to the angularly downwardly extending E-Frame support beams;

(c) three pulley means attached to the upper portion of the I-Frame, wherein a first single grooved pulley means is attached to one end portion of the I-Frame and a second multiple-groove pulley means is attached to the opposite end portion of the I-Frame and a third multiple-groove pulley means is attached to a middle portion of the i-Frame by means of a capstan support, and wherein the first, second and third pulley means are positioned to allow a length of cable to pass from the first pulley means to the third pulley means and from the third pulley means to the second pulley means;

(d) a braking means effective to stop and control the speed of the third pulley means and a pawl means effective to hold the movement of the third pulley means;

(e) two spaced apart parallel vertical support bars with portions thereof connected at right angles to the outer parallel beams of the E-Frame, wherein the upper end portion of the vertical support bars have a window, ceiling, or sill attached means;

(f) two spaced apart parallel horizontal support bars attached at right angles to the vertical support bars forming tow upper parallel spaced apart vertical support bar and horizontal support bar intersections and two lower parallel spaced apart vertical support bar and horizontal support bar intersections, and wherein at least one of the upper or lower intersections are connected to trail ends of the outer parallel beams of the E-Frame which are opposite to the ends connected to the I-Frame;

(g) two tensioning means connecting a portion of the outer parallel beams to a portion of the horizontal support bar forming an intersection which is connected to the trail ends of the outer parallel beams of the E-Frame, said tensioning means effective to tighten the connections at the upper and lower intersections; and II. wherein the second stage comprises, (a) an E-Frame having three spaced apart parallel beams with the two outside beams connected at their respective ends to two support beams extending angularly downward in the same direction, and with downwardly extending ends of the support beams connected to vertical support beams which are connected at their respective upper and lower ends to upper and lower horizontal support beams at right angles to the vertical support beams, and where portions of the upper horizontal support beam are integral with respective portions of the three spaced parallel beams;

(b) an I-Frame comprising at least one beam attached at portions thereof at right angles to portions of the parallel beams of the E-Frame with attached portions of the beam attached to E-Frame beam ends which are attached to angularly downwardly extending E-Frame support beams, (c) two spaced apart parallel vertical support bars with portions thereof connected at right angles to the outer parallel beams of the E-Frame, wherein the upper end portion of the vertical support bars have a window, ceiling or sill attachment means;

(d) two spaced apart parallel horizontal support bars attached at right angles to the vertical support bars forming tow upper parallel spaced apart vertical support bar and horizontal support bar intersections and two lower parallel spaced apart vertical support bar and horizontal support bar intersections, and wherein at least one of the upper or lower intersections are connected to trail ends of the outer parallel beams of the E-Frame which are opposite to the pends connected to the I-Frame;

(e) two tensioning means connecting a portion of the outer parallel beams to a portion of the horizontal support bar forming an intersection which is connected to the trail ends of the outer parallel beams of the E-Frame, said tensioning means effective to tighten the connections at the upper and lower intersections.

11. The apparatus of claim 10 wherein said firs and second stages of said apparatus protrude outside respective windows or into air shafts with the second stage positioned a distance below the first stage, with portion of either ends of the vertical support bars and horizontal support bars forming an interference fit with portions of the window frame or air shaft opening and the vertical and upper and lower horizontal support beams of the E-Frame are bearing against a portion of building below the window,;or air shaft.

12. The hoisting and rescue apparatus of claim 11, further comprising a cable passing through the grooves of the first, second and third pulley means on the I-Frame on the first stage with each cable end suspending downwardly from the first and third pulley means, and wherein each cable end can be operatively moved upward or downward by spinning action of the first, second and third pulley means, and the rate of movement controlled by the brake means and/or pawl means.

13. The hoisting and rescue apparatus of claim 12 wherein each of the cable ends of cable length suspended from the first and third pulley means is connected to a first and second counterweight container effective to operatively move the cable ends upward or downward by gravity force.

14. The hoisting and rescue apparatus of claim 13 wherein the end of cable length suspended from the first and/or third pulley means is attached to a hoisting chain means having said respective counterweight container attached thereto, and wherein the hoisting chain means has one or more attachments for cargo which can be raised up or lowered down in response to upward and downward movement of the cable end.

15. The apparatus of claim 14 further comprising a reel wound with a length of said cable ned suspended from said first or third pulley means, and wherein said reel is prevented from unwinding by the action of a cable linker means, and wherein said hoisting chain means is attached o a portion of said cable linker means.

16. The apparatus of claim 15 wherein said cable linker means connects the first or second counterweight container directly or indirectly attached to a portion thereto to a portion of said cable length suspended from the first or third pulley means.

17. The apparatus of claim 16, further comprising parallel first and second guide wire cables extending downwardly a distance from a portion of the I-beam on the firs stage to respective first and second guide wire reels immobilized at the end of the distance on the second stage.

18. The apparatus of claim 8 wherein the first and second counterweight containers are attached to the first and second guide wire cables by respective guide wire extension means to hold the containers in a substantially straight line while being raised or lowered.

19. The hoisting and rescue apparatus of claim 10, wherein the area defined by said vertical support beams and said upper and lower horizontal support beams in at least one of the first and second stages comprises a backplate in continuous or skeletonized form, and wherein portions of said backplate are integral to said downwardly extending ends of said angularly extending support beams and integral with portions of said E-Frame.

20. The hoisting and rescue apparatus of claim 10, wherein said vertical support bars in at least one of the first and second stages comprise height adjusting means.

21. The apparatus of claim 13, further comprising tow line connector means through which at least one of said ends of said suspended able length is passed, and wherein at least one of said counterweight containers is connected to a portion of said tow line connector means.

22. A process comprising erecting the hoisting and rescue apparatus of claim 10.

* * * * *